United States Patent [19]

Brewster

[11] 4,012,330

[45] Mar. 15, 1977

[54] LITHIUM SALTS OF HYDROCARBON SUBSTITUTED AMIC ACID AS LOW ASH RUST INHIBITORS

[75] Inventor: Philip W. Brewster, Wyoming, Canada

[73] Assignee: Exxon Research & Engineering Co., Linden, N.J.

[22] Filed: Feb. 10, 1975

[21] Appl. No.: 548,615

[52] U.S. Cl. ..... 252/33.6; 252/42

[51] Int. Cl.[2] ..... C10M 1/24

[58] Field of Search ..... 252/33.6

[56] References Cited

UNITED STATES PATENTS

| | | | |
|---|---|---|---|
| 2,640,812 | 6/1953 | Bryant | 252/33.6 |
| 3,042,614 | 7/1962 | Halter et al. | 252/33.6 |
| 3,121,057 | 2/1964 | Gee et al. | 252/33.6 |
| 3,163,603 | 12/1964 | LeSuer | 252/33.6 |
| 3,180,830 | 4/1965 | Siegart et al. | 252/33.6 |
| 3,192,160 | 6/1965 | Gee et al. | 252/33.6 |
| 3,247,110 | 4/1966 | Gee et al. | 252/33.6 |
| 3,347,791 | 10/1967 | Thompson et al. | 252/33.6 |
| 3,634,240 | 1/1972 | O'Halloran | 252/33.6 X |

*Primary Examiner*—Delbert E. Gantz
*Assistant Examiner*—Andrew H. Metz
*Attorney, Agent, or Firm*—Frank T. Johmann

[57] ABSTRACT

The lithium salt of a reaction product of a hydrocarbon-substituted amic acid in which the hydrocarbon substituent contains about 12 to 20 carbon atoms and an amine or ammonia, is effective as rust and corrosion inhibitors in lubricating oil compositions.

9 Claims, No Drawings

LITHIUM SALTS OF HYDROCARBON SUBSTITUTED AMIC ACID AS LOW ASH RUST INHIBITORS

BACKGROUND OF THE INVENTION

1. Field of the Invention

This invention relates to new chemical compositions and to lubricating oil compositions containing these compositions. More particularly, it relates to a novel class of chemical compositions which act as rust and corrosion inhibitors in lubricating oils.

2. Description of the Prior Art

The prior art has taught the need for efficient rust inhibitors in lubricating oils. The need is particularly prevalent in engines which are infrequently operated or which are subject to extended storage in humid climates, because these engines experience excessive rusting of cylinder walls, wrist pins and other polished working surfaces. Under such conditions, moisture accumulates within the engine, penetrates the lubricating film and attacks ferrous surfaces. This attack is aggravated by residues of chlorine and bromine compounds produced in the combustion of gasolines containing tetraethyl lead and scavenging agents such as ethylene dibromide.

The prior art has also recognized the need for efficient corrosion inhibitors in gasoline to prevent or reduce the deposition of lacquer or varnish-like coatings on the walls of cylinders, piston rings, etc., and to prevent or reduce the corrosion of engine parts, bearings, etc. Such corrosion inhibitors, for example, prevent copper-lead bearing corrosion.

Certain alkyl and alkenyl dicarboxylic anhydrides, acids, and various salts thereof have been proposed as ashless or low ash rust inhibitors for motor lubricants. In ashless or low ash formulations, however, these anhydrides and acids can cause considerable copper-lead bearing weight loss. The prior art has generally taught that when using a salt of a hydrocarbon-substituted dicarboxylic acid, the size of the hydrocarbon substituent of the dicarboxylic compound appears to determine the effectiveness of the additive in lubricating oils. Thus, the prior art is replete with statements to the effect that it is critically important that the substituent be large; that is, that it have at least about 50 aliphatic carbon atoms in its structure and the molecular weight of the hydrocarbon substituent should be with the range of about 700 to about 10,000. Because such salts have high molecular weight hydrocarbon substituents, a relatively high weight per cent active ingredient of salts is required in the oil. The shorter chain aliphatic-hydrocarbon-substituted dicarboxylic anhydrides and acids, and their salts, while having rust inhibiting properties, are generally insoluble in oil, and thus present special problems to their successful incorporation as rust inhibitors in lubricating compositions. The rust inhibitors also must be compatible with other additives conventionally used in motor lubricants and sometimes this has also proved to be a problem.

Accordingly, there has been a continuing search for new and improved, economical, low ash rust inhibitors which are compatible with other lubricating oil additives and do not cause significant corrosion.

SUMMARY OF THE INVENTION

It has now been discovered that a nitrogen containing lithium salt composition comprising a lithium salt of $C_{12}$ to $C_{20}$ aliphatic-hydrocarbon substituted amic acid (amides of dicarboxylic acids) can be added to a lubricating oil composition as a low ash antirust additive that provides improved corrosion resistance and which is compatible with a variety of antiwear agents.

The salts used in this invention can be prepared by either of two methods. The first method comprises reacting the hydrocarbon substituted amic acid with a lithium compound to provide the half-lithium salt and then reacting the half-lithium salt with an amine or ammonia. The second method comprises reacting the hydrocarbon substituted dicarboxylic acid with an amine or ammonia and then reacting the resulting amide with a lithium compound. The first method is, however, preferred when using either an amine or ammonia and, indeed, will generally result in higher yields of the desired product with both reactants.

DETAILED DESCRIPTION OF THE INVENTION

The salt composition used in the present invention is obtained from $C_{12}$ to $C_{20}$ aliphatic-hydrocarbon-substituted dicarboxylic anhydrides and acids. Generally, the hydrocarbon substituents may be either alkyl or alkenyl groups or mixtures thereof. Similarly, the dicarboxylic anhydride and/or acid is generally succinic anhydride and/or succinic acid.

Alkenyl-substituted acids and anhydrides can be straight chained or branch chained and are obtained by conventional methods known in the art which involve heating maleic anhydride and an olefinic material together, usually in about equal molar portions. For example, a $C_{12}$ alkenyl succinic acid anhydride can be prepared by the condensation of maleic acid anhydride and a $C_{12}$ fraction of propylene polymer. The reactants are heated with agitation for 20 hours under pressure at a temperature of about 350 to 390° F. under gentle reflux. The reaction product is then allowed to cool and is fractionated under diminished pressure to remove unreacted polymer and low-boiling reaction products. The resulting alkenyl succinic acid anhydride can then be employed directly to produce the half-lithium salts hereinafter described. Alternatively, the anhydrides can be readily purchased as a commercial chemical commodity. In the present invention, either alkenyl succinic anhydrides or the corresponding acids can be used and it is to be understood that any general description involving the use of the anhydride is intended to encompass the use of the equivalent acid as well. Similarly, any general description involving the use of the acid is intended to encompass the use of the equivalent anhydride.

Among the alkenyl-substituted succinic acids and anhydrides which can be used according to the present invention are tetradecenyl, hexadecenyl, octadecenyl, eicosenyl. hexaeicosenyl and octaeicosenyl succinic anhydride or acid, and mixtures thereof. A particularly preferred material is dodecenyl succinic anhydride or acid (hereinafter referred to as DDSA) which can readily be prepared by the addition of tetrapropylene to maleic anhydride. The tetramer of propane, as opposed to the trimer of butene is preferred in preparing DDSA.

In place of the alkenyl succinic acid or anhydride, the corresponding saturated acid or anhydride, or mixtures of saturated and unsaturated materials, can be used. Conversion of the alkenyl group to the alkyl group is usually accomplished by hydrogenation to saturate the double bond, using procedures well known in the art. See, for example, U.S. Pat. No. 2,682,489.

The lithium compounds used in preparing the salts used in the present invention are lithium bases such as lithium oxide, lithium hydroxide, lithium carbonate or lithium alkoxide.

The amines useful in this invention have the general formula

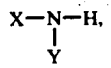

and those wherein at least one of X and Y provide a polar group which can attach to the surface to be protected are preferred. Simple, primary amines, then, which do not provide such a polar group are not preferred.

While the inventor does not wish to be bound by any particular theory, it is believed that effective rust inhibition is obtained by providing an inhibitor which is bonded to the surface to be protected. In the present invention, it is believed that the half-lithium dicarboxylic acid salt portion of the additive provides the rust inhibition while the amine portion of the additive provides a polar group which can attach to the surface to be protected.

The amines useful in this invention include alkylene polyamines and hydroxyalkyl-substituted alkylene polyamines. Specific amines which are contemplated are exemplified by: ethylene diamine, triethylene tetramine, propylene diamine, decamethylene diamine, octamethylene diamine, di(heptamethylene) triamine, tripropylene tetramine, tripropylene tetramine, tetraethylene pentamine, trimethylene diamine, tetra-ethylene hexamine, di(trimethylene) triamine, 2-heptyl-3-(2-aminopropyl)imidazoline, 1,3-bis(2-aminoethyl) imidazoline, pyrimidine, 1-(2-aminopropyl) piperazine, 1,4-bis(2-aminoethyl) piperazine, and 2-methyl-1-(2-aminobutyl) piperazine. Higher homologues such as are obtained by condensing two or more of the above-illustrated alkylene amines are likewise useful.

Hydroxylalkyl-substituted alkylene polyamines, i.e., alkylene polyamines having 1 or more hydroxyalkyl substituents on a nitrogen atom, are likewise contemplated for use within this invention. The hydroxyalkyl-substituted alkylene polyamines are preferably those in which the alkyl group is lower alkyl group, i.e., having less than about 6 carbon atoms. Examples of such amines include N-(2-hydroxyethyl)ethylene diamine, N,N'-bis(2-hydroxyethyl) ethylene diamine, 1-(2-hydroxyethyl)piperazine, lower hydroxypropyl-substituted diethylene triamine, di-hydroxypropyl-substituted tetraethylene pentamine, and N-(3-hydroxypropyl) tetramethylene diamine.

Higher homologues such as are obtained by condensation of the above-illustrated alkylene amines with hydroxy-alkyl-substituted alkylene amines through amino radicals or through hydroxy radicals are likewise useful. It will be appreciated that condensation through amino radicals results in a higher polyamine accompanied by removal of ammonia and that condensation to the hydroxyl radicals results in products containing ether linkages accompanied by removal of water.

The ethylene polyamines are especially useful in this invention. They are described in detail under the heading "Ethylene Amines" in "Encyclopedia of Chemical Technology." Kirk and Othmer, volume 5, pages 898–905, Interscience Publishers, New York (1950). Such compounds are prepared by the reaction of an alkylene chloride with ammonia which results in the production of complex mixtures of alkylene polyamines, including cyclic condensation products such as piperazines. These mixtures find use in the processes of this invention. On the other hand, quite satisfactory products may be obtained also by the use of pure alkylene polyamines. An especially useful alkylene polyamine for reasons of economy as well as the effectiveness of the products derived therefrom, is a mixture of ethylene polyamines prepared by the reaction of ethylene dichloride and ammonia and having a composition which, in its elemental analysis, corresponds to that of tetraethylene pentamine.

Another especially useful amine for reasons of economy as well as the effectiveness of the products derived therefrom is a mixture of poly(trimethylene) polyamines and the 1,3-trimethylene diamine derived from the reaction of acrolein and ammonia.

As will be readily appreciated, each of the above described polyamines provides at least one polar group in addition to a nitrogen atom it contains. When ammonia is used, it is believed that the ammonia reacts with the dicarboxylic acid portion of two molecules to link these two molecules by an imino group -NH which acts to provide a good surface bond. This product is illustrated by the following formula:

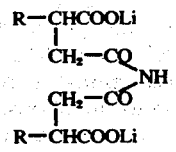

where R and R' are either the same or a different alkyl or alkenyl group having 12 to 20 carbon atoms.

The process of this invention can be carried out either by (1) first preparing the acylated amine of the hydrocarbon-substituted dicarboxylic compound and then reacting the acylated amine with the lithium compound, or by (2) first preparing the mono-lithium salt of the hydrocarbon-substituted dicarboxylic compound and then reacting the mono-lithium salt with ammonia or an amine such as an alkylene polyamine or hydroxyalkyl-substituted alkylene polyamine. In the second method, it is preferred that the dicarboxylic compound be succinic acid. In all cases, it is preferred that nitrogen or some such inert gas be bubbled through the reaction mixture to remove any water formed as a result of the acylation reaction.

The first method is illustrated by the following equations:

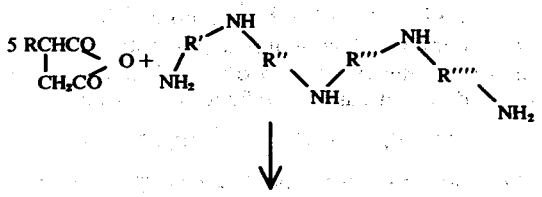

-continued

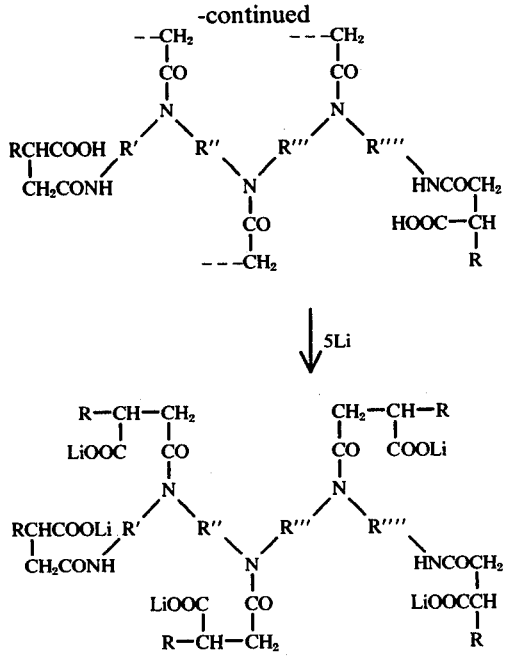

wherein R is an alkyl or alkenyl group having 12 to 20 carbon atoms or a mixture of two or more such groups and R′ – R′′′′ are the same or different substituted or unsubstituted divalent hydrocarbon radicals corresponding to those of the particular amine or amines actually employed. The second method, on the other hand, is more simply illustrated by the followng equation:

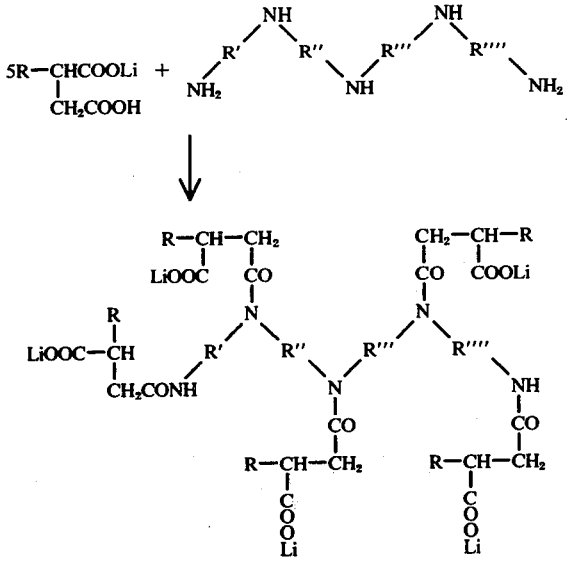

wherein R, R′, R′′, R′′′, and R′′′′ are as previously indicated in the equations illustrating the first method.

With respect to the aforementioned methods, it should be noted that a rather broad range of products is possible, ranging from those wherein one amine nitrogen is converted to an amide to those wherein all amine groups are so converted. Similarly, the ultimate product may contain from only one lithium atom per molecule to one lithium atom per amine nitrogen in the amine actually used.

The first method above involves (A) mixing a dicarboxylic compound that can be selected from the class consisting of hydrocarbon-substituted succinic acids and hydrocarbon-substituted succinic anhydrides wherein the hydrocarbon substituent has between 12 to 20 aliphatic carbon atoms, with at least one equivalent of an amine that can be selected from the class consisting of alkylene polyamines and hydroxyalkyl-substituted alkylene polyamines, and heating the resulting mixture to effect acylation and to form an acylated amine, and to remove the water formed thereby, and then (B) mixing said acylated amine with about one equivalent of a lithium compound from the class consisting of lithium oxide, hydroxide, carbonate and lower alcoholates, and heating the resulting mixture at a temperature within the range of from about 20° to about 250° C.

The second variant of the process comprises reacting at a temperature within the range of from about 50° to about 350° F. (A) one equivalent of a half-lithium salt of a hydrocarbon-substituted succinic acid in which the hydrocarbon substituent has from 12 to 20 aliphatic carbon atoms with (B) at least about one equivalent of ammonia or an amine selected from the class consisting of alkylene polyamines and hydroxyalkyl-substituted alkylene polyamines.

The half-lithium salt can be prepared by heating at a temperature with the range of from about 80° to about 130° C., one mole of a hydrocarbon substituted succinic acid with about one mole of a lithium compound such as lithium oxide, lithium hydroxide, lithium carbonate and lower alcoholates of lithium, for a period of time from about 1 hour to about 5 hours. The temperature can be as low as 20° C. although usually it should be within the range above. Also, it is preferred that the reaction of the half-lithium succinate with the amine is best carried out at a temperature within the range of from about 80° to about 160° C. It usually requires from about 3 to about 5 hours.

The use of a solvent such as toluene, mineral oil and the like is sometimes desirable.

The lithium succinates are illustrated by the structural formula:

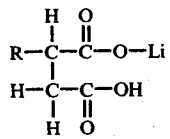

where R is a hydrocarbon substituent having from 12 to 20 carbon atoms.

The lower alcoholates referred to in this invention are alcoholates containing from one to about 16 carbon atoms. Examples of these alcoholates include methylates, ethylates, propylates, butylates, hexylates and the like.

The low molecular weight lithium salts of this invention are derived from hydrocarbon substituted amic acids containing 12 to 20 carbon atoms in the hydrocarbon substituent and are not especially soluble in lubricating oil compositions. As a result, a dispersing agent or solubilizing agent is generally employed. Suitable dispersing agents include amide condensates of polyisobutenyl propionic acid and tetraethylene pentamine (see British Pat. No. 1,075,121), as well as high molecular weight polyisobutenyl succinic acid and tetraethylene pentamine, and high molecular weight polyisobutenyl amic acid and tetraethylene pentamine.

While it is possible to disperse the low molecular weight lithium salts of this invention into lubricated oil compositions with the aid of dispersing agents, it is much preferred to work with oil soluble additives as opposed to oil dispersible additives.

There are a number of oxygen-containing compounds which will solubilize the lithium salts of the aliphatic-hydrocarbon-substituted dicarboxylic acids or anhydrides of the present invention. Among these are tall oil fatty acids and alcohols such as isooctanol and nonanol. Of all the oxygen-containing materials that can be used as solubilizers, the alkyl phenols are preferred because they make the salts soluble in lubricating oils without destroying the copper-lead corrosion inhibiting properties of the salts and allow the preparation of a stable liquid concentrate. The phenols that can be used include alkyl phenols having a total of 5 to 30, and preferably 8 to 26, carbon atoms in their alkyl side chains and may be polyhydric phenols containing more than one ring structure. The so-called bis phenols may be used, also acyl phenols, amino phenols, acetyl phenols and dialkyl phenols. Thus, typical compounds include 2,2-bis-(2-hydroxy - 3 -tert-butyl -5 -methylphenyl)-propane, diethylamino phenols, benzyl amino phenols, acyl amino phenols, for example, N-propionyl-p-aminophenol, acetyl phenol, and their homologues. Condensation products of such phenols with aldehydes or ketones, e.g., formaldehyde and acetone, may also be used.

The phenol that is used to solubilize the lithium salts of this invention can be present when the salt is made, or can be added later. Reaction time of combining these components is not critical. The only requirement is that the phenol be present while the temperature of the mixture is at least as high as the melting point of the salt. Thus, the solubilization which must be carried out while the salt is in liquid phase can be effected at a temperature range of about 300° to about 500° F.

It is to be understood that the exact nature of the compositions formed upon the addition of the alkyl phenol has not been determined and, while they have been referred to as solubilized lithium salts, it is possible that a lithium phenate complex has been formed between the ASA, the lithium base, and the alkyl phenol or that some other undetermined compositional structure has resulted.

Experiments indicate that the mole ratio of salt to phenol may range from about 15:1 to about 0.5:1.

This invention contemplates the use of 0.01 to 50 weight percent of the products of the present invention in oil compositions. As stated above, the lithium salts of the present invention, in combination with an alkyl phenol, are useful as antirust additives in lubricating oils and when combined with a lubricating oil will form homogeneous liquid lubricating oil compositions which are stable at ambient temperatures. When used as antirust additives, they can be incorporated in lubricating oil compositions in concentrations within the range of from about 0.2 to about 10 weight percent active ingredient, but will ordinarily be used in concentrations of from about 0.2 to about 4.0 weight percent.

The lubricating oils to which the additives of the invention can be added include not only mineral lubricating oils, but synthetic oils also. The mineral lubricating oils may be of any preferred types, including those derived from the ordinary paraffinic, naphthenic, asphaltic, or mixed base mineral crude oils by suitable refining methods. The synthetic oils include synthetic hydrocarbon lubricating oils, as well as dibasic acid esters such as di-2-ethyl hexyl sebacate, carbonate esters, phosphate esters halogenated hydrocarbons, polysilicones, polyglycols, glycol esters such as $C_{13}$ OXO acid diesters of tetraethylene glycol, and complex esters, as for example the complex ester formed by the reaction of 1 mole of sebacic acid with 2 moles of tetraethylene glycol and 2 moles of 2-ethyl hexanoic acid.

While the lubricant compositions herein described are primarily designated as internal combustion engine crankcase lubricants, the additives of the invention may also be employed in other oil compositions, including turbine oils, various industrial oils, gear oils, hydraulic fluids, transmission fluids and the like.

It is within the contemplation of this invention to prepare easily handled liquid additive concentrates in which the concentration of additives is greater than would normally be employed in a finished lubricant. These concentrates may contain in the range of from 10 to 50% of additive on an active ingredient basis, the balance being mineral oil. Such concentrates are convenient for handling the additive in the ultimate blending operation into a finished lubricating oil composition. The additive concentrates can be made up simply by combining the lithium salts and alkyl phenol of the present invention in a suitable mineral oil medium. The additive package can also include other additives that are intended for use along with the additives of the invention in a finished lubricant. Such additives include, for example, detergents and dispersants of the ash-containing or ashless type, oxidation inhibiting agents, viscosity index improving agents, pour point depressants, extreme pressure agents, color stabilizers and antifoam agents. Typical examples of additives serving these purposes are known to those skilled in the art.

Alternatively, although not preferably, the alkyl phenol and the lithium salt can be combined in any aliphatic or aromatic hydrocarbon with a boiling point of about 400° F. or higher, e.g., ortho-cresol or cetane, which, can then be boiled off to leave a readily soluble additive in solid form.

DESCRIPTION OF THE PREFERRED EMBODIMENTS

Whereas mentioned previously, the lithium amine salts of the instant invention may be prepared via either of two methods, the first method which comprises reacting the hydrocarbon-substituted amic acid with a lithium compound to provide the half-lithium salt and then reacting the half-lithium salt with an amine or ammonia is preferred. This method generally will result in higher yields of the desired product with both reactants.

Similarly, with respect to this first method, it is preferred that the dicarboxylic compound be succinic anhydride and that trace amounts of water, i.e., up to about 2.5% by weight, be present when the basic lithium compound is an oxide. Nitrogen or some other such inert gas is bubbled through the reaction mixture to remove any water formed as a result of the acylation reaction.

With respect to the preferred embodiment, it should be noted that rather broad range of products is possible, ranging from those wherein one amine nitrogen is converted to an amide to those wherein all amine groups are so converted. Similarly, the ultimate product may contain only one lithium atom per molecule to one lithium atom per amine nitrogen in the amine actually used. Although such a range of products is possible, the invention prefers those products having one amide group and one lithium atom for each nitrogen. When the reaction conditions are controlled as set forth below, the preferred products are dominant.

The preferred amines useful in this invention have the general formula

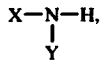

wherein at least one of X and Y provide a polar group which can attached to the surface to be protected.

Another preferred source of the amine groups consists of alkylene polyamines conforming for the most part of the formula

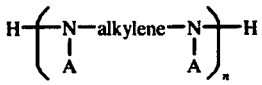

wherein $n$ is an integer preferably less than about 10, A is a hydrocarbon radical or hydrogen or an amino hydrocarbon radical, and the alkylene radical is preferably a lower alkylene radical having less than about 8 carbon atoms. The most preferred of such amines is tetraethylene pentamine (TEPA).

The acylation reaction is preferably carried out at a temperature within the range of from about 80° to about 160° C. and for a period of time within the range of from about 3 hours to about 5 hours. The acylated amine preferably is formed by having one mole of succinic acid present for each nitrogen atom in the amine. For example, when using the preferred tetraethylene pentamine, a mole ratio of succinic compound to amine of 5:1 is preferably used.

The low molecular weight lithium salts of this invention are derived from hydrocarbon-substituted amic acids containing 12 to 20 carbon atoms in the hydrocarbon substituent. The lithium salts are not particularly soluble in lubricating oil compositions. Accordingly, a dispersing agent or solubilizing agent is generally employed. The preferred dispersing agent is the amide condensate of polyisobutenyl propionic acid and tetraethylene pentamine.

Where dispersing agents are not used, it is preferred to work with oil soluble additives as opposed to oil dispersable additives.

Furthermore, as a practical matter, it is preferred and predominantly the practice to blend additives into lubricating compositions in concentrate form. Usually in a concentrate, the weight percent of active ingredient ranges from about 10 to about 80 weight percent, for there is no economic advantage in using concentrates having less than 10 weight percent active ingredient. However, if one attempts to prepare concentrates wherein the weight percentage of oil insoluble lithium salt of ASA is greater than 10, using dispersants, such concentrates will form solid gels at ambient temperatures, thus presenting a number of disadvantages in their handling in subsequent blending operations.

The invention prefers as oxygen containing compounds which will solubilize the lithium salts of the invention, monoalkylated monohydroxy phenols whose molecular weights are between 150 and 700. Especially preferred are monoalkylated phenols having 8 to 12 alkyl carbon atoms. More specifically, effective compounds include p-octyl phenol, mixed nonyl phenols, mixed dodecyl phenols, and dihexyl phenol.

As expressed previously, the reaction time of combining the phenol that it is used to solubilize the lithium salts of this invention is not critical. However, this solubilization is preferably carried out at a temperature range of about 350° F. to about 450° F. Similarly the preferred mole ratio of salt to phenol will range from about 8:1 to about 1:1. When the products of the present invention are used as additives in oil compositions, the preferred concentrations range from about 0.4 to about 2.0 weight percent active ingredient.

The following examples will serve to illustrate methods of preparing the compositions of this invention and include preferred embodiments of said invention.

EXAMPLE 1

The half-lithium salt of dodecenyl succinic acid is prepared by diluting five moles of dodecenyl succinic acid with an equal volume of a solvent refined, hydrofinished Western Canadian paraffinic distillate having a nominal VI (viscosity index) of 90 and a viscosity of 150 SUS (Saybolt Universal seconds) at 100° F. The mixture is heated to 260° to 280° F. in a Hobart mixer, and an aqueous solution containing five moles of lithium hydroxide monohydrate in 1500 gms. of hot water is added dropwise over a period of 120 minutes at a rate sufficient to avoid foaming. At this temperature, all of the water flashes off and is rapidly evaporated. Upon completion of the addition of the lithium hydroxide solution, the temperature is raised to 300° F. and one mole of tetraethylene pentamine is added gradually over 60 minutes. The reaction is carried out for 5 hours at 300° F. The resulting product is maintained at 300° F. and 150 grams of nonyl phenol is added with mixing to provide a composition which upon cooling to room temperature will not solidify and will remain a liquid. The cooled composition is an additive concentrate suitable for lubricating oil blending operations.

EXAMPLE 2

Two blended oil compositions are prepared containing 2.0 weight percent active ingredient of the additive of Example 1. The first oil composition, in addition to the additive of Example 1, contains, on a weight percent basis, (1) 4.0% of a dispersant obtained by reacting a high molecular weight polyisobutene succinic acid (molecular weight of polyisobutene 900) with tetraethylenepentamine in a 2.8:1 molar ratio; (2) 1.0% of an oil composition consisting of 26 weight percent of a hydrocarbon lubricating oil and 74 weight percent of a zinc dialkyl dithiophosphate prepared from a mixture of acids derived from 65% isobutyl alcohol and 35% primary amyl alcohol; (3) 0.025% of a silicone type antifoam agent; and (4) 92.975% of a SAE 30 base oil having a viscosity of about 69 SUS at 210° F. The second oil composition, in addition to the additive of Example 1, contains (1) 4.0% of a dispersant obtained by reacting a high molecular weight polyisobutene succinic acid (molecular weight of polyisobutene is 900) with tetraethylenepentamine in a 2.8:1 molar ratio; (2) 1.2% of an oil composition consisting of 26 weight percent of a hydrocarbon lubricating oil and 74 weight percent of a zinc dialkyl dithiophosphate prepared from a mixture of acids derived from 65% isobutyl alcohol and 35% primary amyl alcohol; and (3) 92.755% of the same SAE 30 base oil.

A third oil composition is prepared containing (1) 6% active rust inhibitor of the reaction product of the half-lithium salt of a high molecular weight polyisobutylene succinic acid (molecular weight of polyisobutylene substituent is 900) with tetraethylene pentamine in a molar ratio of 5:1; (2) 1.2% of an oil composition consisting of 26 weight percent of a hydrocarbon lubricating oil and 74 weight percent of a zinc dialkyl dithiophosphate prepared from a mixture of acids derived from 65% isobutyl alcohol and 35% primary amyl alcohol; (3) 0.02% of a silicone type antifoam agent; and (4) 92.775% of the same SAE 30 base oil.

Each of the above three oil compositions are tested for rust performance. To determine rust inhibition, the General Motors MS series test is used, employing a sequential MSIIB engine merit test. The MSIIB engine test entails running the regular MSIIB low temperature cycle, then disassembling only the parts to be rust rated. The engine crankcase is then drained, filled with new test oil (plus dummy rust test parts) and run to flush the system of all the oil and residue from the first run. Then new parts and fresh test oil are placed in the engine for the next run. The MSIIB series of tests is described in ASTM Special Technical Publication 315D.

The MSIIB rust rating varies from around 3.0 to 10 with higher values indicating better results. Values of 8.4 – 8.9 are common for present day crankcase oils.

The first and second oil compositions containing the rust inhibitors of the present invention each have a rust rating of 8.7 as does the third oil composition. The additives of the present invention, however, are present at a 2wt. percent active ingredient level whereas the active ingredient of the third composition is present at the much higher level of 6.0%.

EXAMPLE 3

The half-lithium salt of dodecenyl succinic acid is prepared by first diluting 1,000 grams of dodecenyl succinic acid with 1,000 grams of an SAE 10 grade oil which was solvent and having a typical VI of 90 and a viscosity of 150 SUS at 100° F. extracted and/or hydrofinished in a Hobart mixer equipped with a heating mantle. The mixture becomes homogeneous and the temperature is raised to 260° F. A solution of 158 grams of lithium hydroxide monohydrate in 1000 grams of hot water is added dropwise to the stirred hot DDSA/oil mixture. The water flashes off rapidly and the addition is complete in 60 minutes. A further 30 minute period of heatsoak at 260° to 270° F. gives a clear, viscous anhydrous product. The temperature of the anhydrous product is raised to 300° F. and tetraethylene pentamine is added in an amount of 142 grams. The reaction is complete in 5–7 hours.

A rust inhibitor additive of this invention was used in a fully formulated 10W-30 crankcase motor oil containing an ashless dispersant which is the reaction product of polyisobutenyl succinic anhydride with a polyamine, a zinc dialkyl dithiophoshpate as oxidation inhibitor, an ethylene-propylene copolymer, a non-alkylated naphthalene dispersant and a silicone antifoamant.

The rust inhibitor additive, identical to that of Example 3, is added to this blended base oil in an amount of 0.5 weight percent active ingredient and the resulting composition is tested in the MSIIB rust engine test in accordance with the procedure in Example 2 above. The MSIIB rust rating for this composition is 9.4.

The invention in its broader aspects is not limited to the specific details shown and described and departures may be made from such details without departing from the principles of the invention and without sacrificing its chief advantages.

What is claimed is:

1. An oil composition comprising a major proportion of lubricating oil, and a minor rust inhibiting proportion, in the range of about 0.2 to 4.0 weight percent, of lithium salt of an amide of a hydrocarbon substituted succinic acid; said hydrocarbon substituent containing 12 to 20 carbon atoms and being selected from the group consisting of alkenyl and alkyl groups; said amide being the reaction product of said acid with a nitrogen material selected from the group consisting of ammonia, alkylene polyamines of the general formula:

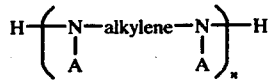

wherein $n$ is an integer less than about 10 and A is selected from the group consisting of hydrogen and a lower alkylene radical having less than about 8 carbon atoms, and said alkylene polyamines substituted with one or more hydroxy alkyl substituents on a nitrogen atom, in which the hydroxy alkyl group has less than about six carbon atoms.

2. An oil composition according to claim 1, wherein said nitrogen material is a polyethyleneamine.

3. An oil composition according to claim 2, wherein said nitrogen material is tetraethylene pentamine.

4. An oil composition according to claim 3, wherein about five molar proportions of said succinic acid is reacted per about one molar proportion of said tetraethylene pentamine, and there is about one lithium atom per amine nitrogen.

5. An oil composition according to claim 2, wherein said succinic acid is dodecenyl succinic acid.

6. An oil composition according to claim 4, wherein said succinic acid is dodecenyl succinic acid.

7. An oil composition according to claim 1, including an alkyl phenol having a total of about 5 to about 30 alkyl carbon atoms, in an amount sufficient to solubilize said lithium salt in said lubricating oil.

8. A rust inhibiting oil concentrate comprising a mineral oil and about 10 to 50 wt. % of the lithium salt of the amide of dodecenyl succinic acid and tetraethylene pentamine.

9. An oil concentrate according to claim 37, which contains alkyl phenol as a solubilizing agent for said lithium salt in a mole ratio of about 15 to 0.5 moles of said lithium salt per mole of said alkyl phenol, and wherein said alkyl groups of said alkyl phenol contain 8 to 12 carbon atoms.

* * * * *